US009921518B2

(12) United States Patent
Sakurai et al.

(10) Patent No.: US 9,921,518 B2
(45) Date of Patent: Mar. 20, 2018

(54) DEVELOPING ROLLER, WITH CONDUCTIVE ELASTIC LAYER HAVING EXPOSED PROTRUSIONS, CARTRIDGE AND APPARATUS

(71) Applicant: CANON KABUSHIKI KAISHA, Tokyo (JP)

(72) Inventors: Yuji Sakurai, Susono (JP); Kazutoshi Ishida, Mishima (JP); Ryo Sugiyama, Mishima (JP); Rieko Takabe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/440,186

(22) Filed: Feb. 23, 2017

(65) Prior Publication Data

US 2017/0248867 A1 Aug. 31, 2017

(30) Foreign Application Priority Data

Feb. 26, 2016 (JP) ..... 2016-035964

(51) Int. Cl.
*G03G 15/08* (2006.01)
*G03G 21/18* (2006.01)

(52) U.S. Cl.
CPC ..... *G03G 15/0808* (2013.01); *G03G 15/0818* (2013.01); *G03G 21/18* (2013.01)

(58) Field of Classification Search
CPC . G03G 15/0808; G03G 15/0818; G03G 21/18
USPC ..... 399/286
See application file for complete search history.

(56) References Cited

U.S. PATENT DOCUMENTS

| | | | |
|---|---|---|---|
| 6,725,002 | B2 | 4/2004 | Sakurai et al. |
| 7,201,967 | B2 | 4/2007 | Sakurai et al. |
| 7,798,948 | B2 | 9/2010 | Kawamura et al. |
| 7,979,004 | B2 | 7/2011 | Tanaka et al. |
| 8,600,273 | B2 | 12/2013 | Yamada et al. |
| 8,655,238 | B2 | 2/2014 | Uno et al. |
| 8,660,472 | B2 | 2/2014 | Kurachi et al. |
| 8,706,011 | B2 | 4/2014 | Anan et al. |

(Continued)

FOREIGN PATENT DOCUMENTS

JP H08-286497 11/1996

*Primary Examiner* — Susan Lee
(74) *Attorney, Agent, or Firm* — Fitzpatrick Cella Harper and Scinto

(57) ABSTRACT

It is directed to providing a developing roller capable of forming a high-quality electrophotographic image. The developing roller includes a substrate, an electro-conductive elastic layer on the substrate, and a plurality of electrical insulating domains on the electro-conductive elastic layer. The developing roller has a length L of 200 mm or more in a longitudinal direction orthogonal to the circumferential direction thereof. The surface of the developing roller includes the surfaces of the domains and an exposed portion of the electro-conductive elastic layer, the exposed portion being uncovered with the domains. The developing roller has protrusions on the surface thereof, the protrusion being formed by the domains. The electro-conductive elastic layer has a plurality of protrusions at the exposed portion. The developing roller has an Asker C hardness of 50 degrees or more and 90 degrees or less.

11 Claims, 6 Drawing Sheets

(56) References Cited

U.S. PATENT DOCUMENTS

| | | | | |
|---|---|---|---|---|
| 8,768,226 | B2 | 7/2014 | Koyanagi et al. | |
| 8,774,677 | B2 | 7/2014 | Sakurai et al. | |
| 8,798,508 | B2 | 8/2014 | Yamada et al. | |
| 8,837,985 | B2 | 9/2014 | Ishida et al. | |
| 8,846,287 | B2 | 9/2014 | Yamada et al. | |
| 9,017,239 | B2 | 4/2015 | Ishida et al. | |
| 9,482,986 | B2 * | 11/2016 | Sakurai | G03G 15/0808 |
| 2006/0067747 | A1 | 3/2006 | Matsuda et al. | |
| 2006/0226572 | A1 | 10/2006 | Tanaka et al. | |
| 2013/0130022 | A1 | 5/2013 | Uesugi et al. | |
| 2013/0164038 | A1 | 6/2013 | Kusaba et al. | |
| 2013/0266339 | A1 | 10/2013 | Sugiyama et al. | |
| 2017/0097580 | A1 | 4/2017 | Ishida et al. | |

* cited by examiner

DEVELOPING ROLLER, WITH CONDUCTIVE ELASTIC LAYER HAVING EXPOSED PROTRUSIONS, CARTRIDGE AND APPARATUS

BACKGROUND OF THE INVENTION

Field of the Invention

The present disclosure relates to a developing roller, a process cartridge and an electrophotographic image forming apparatus.

Description of the Related Art

In electrophotographic image forming apparatuses, a developing apparatus usually includes members for electrography such as the following (1) to (3):

(1) a developer feed roller which resides in a developer container and feeds toner to a developing roller;

(2) a developer amount regulating member which forms a toner layer on the developing roller and keeps a fixed amount of toner on the developing roller; and (3) the developing roller which covers the opening of the developer container that accommodates toner, while exposing a portion of the developing roller to the outside of the container, in which the exposed portion is disposed to face a photosensitive member to develop the toner on the photosensitive member.

In order to improve the toner conveying ability of a developing member, Japanese Patent Application Laid-Open No. H8-286497 discloses a developing roller in which the surface of an electro-conductive portion is provided with a dielectric portion having a high electric resistance value, and toner can be electrically adsorbed onto the charged dielectric portion to convey the toner.

SUMMARY OF THE INVENTION

One aspect of the present disclosure is directed to providing a developing roller having an excellent toner conveying ability and contributing to the stable formation of a high-quality electrophotographic image. Another aspect of the present disclosure is directed to providing a process cartridge and an electrophotographic image forming apparatus which contribute to the stable formation of a high-quality electrophotographic image.

According to one aspect of the present disclosure, there is provided a developing roller comprising:

a substrate;

an electro-conductive elastic layer on the substrate; and a plurality of electrical insulating domains on the electro-conductive elastic layer, wherein the developing roller has a length L of 200 mm or more in a longitudinal direction orthogonal to the circumferential direction thereof, the surface of the developing roller comprises:

the surfaces of the domains; and an exposed portion of the electro-conductive elastic layer, the exposed portion being uncovered with the domains, the developing roller has protrusions on the surface thereof, the protrusion being formed by the domains, the electro-conductive elastic layer has a plurality of protrusions at the exposed portion, the developing roller has an Asker C hardness of 50 degrees or more and 90 degrees or less, and the developing roller satisfies the following (1) and (2):

(1) a surface potential of the developing roller at the domains is 10 V or more and 100 V or less corresponding to a completion of discharge, and a surface potential of the developing roller at the exposed portion of the electro-conductive elastic layer is 2 V or less corresponding to a completion of discharge, the charging of the surface of the developing roller being conducted with a discharge wire which is disposed substantially parallel to the longitudinal direction of the developing roller and so that the discharge wire is apart from the surface of the developing roller by 1 mm, by applying a direct-current voltage of 8 kV between the developing roller and the discharge wire in an environment of a temperature of 23° C. and a relative humidity of 50%, and (2) when a nip region having a nip width of 1.0 mm and an area of 1.0 mm×L mm is demarcated by pressing the surface of the developing roller against a flat glass plate, assuming that a square region of 0.3 mm on a side is placed in the nip region, and total sum of areas of contacted portions between the exposed portion of the electro-conductive elastic layer and the flat glass plate in the square region is defined as "$S_T$" mm$^2$, a percentage ratio of $S_T$ to the area 0.09 mm$^2$ of the square region, $100*S_T/0.09$, is 0.50% or more and 10.00% or less.

According to another aspect of the present disclosure, there is provided an electrophotographic process cartridge which is configured to be detachably attachable to a body of an electrophotographic apparatus, including a developing apparatus, the developing apparatus having the developing roller described above.

According to still another aspect of the present disclosure, there is provided an electrophotographic image forming apparatus including an image bearing member which bears an electrostatic latent image, a charging apparatus which charges the image bearing member, an exposure apparatus which forms an electrostatic latent image on the charged image bearing member, a developing apparatus which develops the electrostatic latent image with toner to form a toner image, and a transfer apparatus which transfers the toner image to a transfer material, the developing apparatus having the developing roller described above.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to the studies of the present inventors, the developing roller according to Japanese Patent Application Laid-Open No. H8-286497 has an excellent toner conveying ability owing to the presence of the dielectric portion on the surface, but is not always satisfactory in terms of the quality of an electrophotographic image formed using the developing roller. Particularly, in the case of forming an electrophotographic image in a low-temperature and low-humidity environment, for example, at a temperature of 15° C. and a relative humidity of 10%, using an electrophotographic image forming apparatus equipped with a new developing roller according to Japanese Patent Application Laid-Open No. H8-286497, an electrophotographic image obtained immediately after the start of electrophotographic image formation particularly has inadequate quality.

The present inventors have presumed, as follows, the reason why the electrophotographic image that is formed by using the developing roller according to Japanese Patent Application Laid-Open No. H8-286497 is still inadequate in terms of its quality.

In a developing roller including a surface having an electrical insulating domain (hereinafter, also referred to as an "insulating domain") and an electro-conductive portion, an electric field between the insulating domain and the electro-conductive portion is generated by charging the insulating domain. Toner is adsorbed onto the insulating domain through Coulomb's force and gradient force. Therefore, a stable amount of toner can be reliably conveyed to a development region. The potential of the insulating domain can be raised by increasing the size of the insulating domain and increasing a charge amount of the insulating domain. As a result, the toner conveying ability of the insulating domain can be enhanced. The insulating domain is charged by rubbing with toner or rubbing with a member in contact therewith. Therefore, the chance to rub with toner or a member in contact therewith can be increased by allowing the insulating domain to have a protruding shape. Furthermore, the charge amount of the insulating domain can be further increased.

Figure 9:
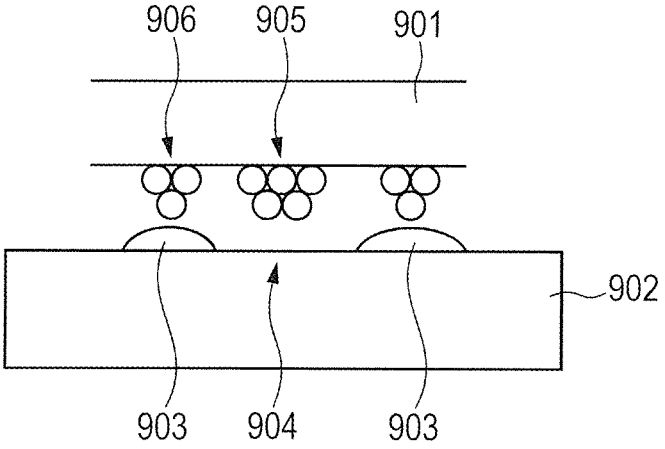
FIG. 9 PRIOR ART
FIG. 9 is a view illustrating the state of an uneven amount of toner on a photosensitive member when an electrostatic latent image is developed on the photosensitive member using a conventional developing roller.

On the other hand, the toner held by the developing roller is conveyed to a development region where an electrostatic latent image on a photosensitive member (image bearing member) is developed with the toner. This development is mainly carried out by the difference in potential between the developing roller and the photosensitive member. In this context, in the development region, difference in developing potential contrast occurs between the insulating domain and the electro-conductive portion. As a result, as illustrated in FIG. 9, the amount of toner (906) attached to a portion, on the surface of photosensitive member 901, facing insulating domain 903 of developing roller 902 differs from the amount of toner (905) attached to a portion facing electro-conductive portion 904. In short, the amount of toner attached to the photosensitive member is rendered uneven. If a toner image with the different amounts of toner attached depending on sites on the photosensitive member is directly transferred to a recording medium such as paper, an electrophotographic image having an uneven density and reduced quality is formed. Particularly, the insulating domain has high electric resistance in a low-temperature and low-humidity environment, and the developing potential contrast is increased between the insulating domain and the electro-conductive portion. Therefore, it is considered that the quality of the electrophotographic image is more likely to be reduced.

Based on such consideration, the present inventors have further conducted studies and consequently found that a developing roller having configuration as described below has an excellent toner conveying performance and is capable of suppressing an electrophotographic image roughness attributed to an uneven amount of toner, which develops an electrostatic latent image on a photosensitive member surface, resulting from the developing potential contrast between an insulating domain and an electro-conductive portion.

Specifically, the developing roller according to one aspect of the present invention includes a substrate, an electro-conductive elastic layer on the substrate, and a plurality of insulating domains on the electro-conductive elastic layer. The developing roller has a length L of 200 mm or more in a longitudinal direction orthogonal to the circumferential direction thereof, and the surface of the developing roller includes the surfaces of the insulating domains and an exposed portion of the electro-conductive elastic layer, the exposed portion being uncovered with the insulating domains. The developing roller has protrusions which are formed by the insulating domains. That is, the insulating domains form protrusions on the surface of the developing roller. Further, the developing roller has protrusions at the exposed portion of the electro-conductive elastic layer. The developing roller has an Asker C hardness of 50 degrees or more and 90 degrees or less.

The developing roller satisfies the following (1) and (2).

(1) A surface potential of the developing roller at the insulating domains is 10 V or more and 100 V or less corresponding to a completion of discharge, and a surface potential of the developing roller at the exposed portion of the electro-conductive elastic layer is 2 V or less corresponding to a completion of discharge. The charging of the surface of the developing roller is conducted with a discharge wire which is disposed substantially parallel to the longitudinal direction of the developing roller and so that the discharge wire is apart from the surface of the developing roller by 1 mm, by applying a direct-current voltage of 8 kV between the developing roller and the discharge wire in an environment of a temperature of 23° C. and a relative humidity of 50%.

(2) When a nip region having a nip width of 1.0 mm and an area of 1.0 mm×L mm is demarcated by pressing the surface of the developing roller against a flat glass plate, assuming that a square region of 0.3 mm on a side is placed in the nip region, and total sum of areas of contacted portions between the exposed portion of the electro-conductive elastic layer and the flat glass plate in the square region is defined as "$S_T$" $mm^2$, a percentage ratio of $S_T$ to the area of the square region, i.e. "$100*S_T/0.09$", is 0.50% or more and 10.00% or less.

Figure 1A:
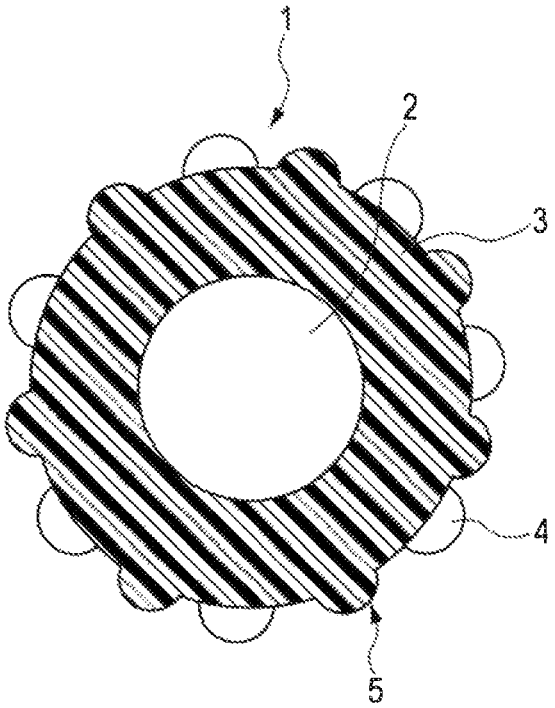
FIG. 1A is a schematic view illustrating a configuration at a cross section in a direction orthogonal to the longitudinal direction of the developing roller according to one aspect of the present invention.
Figure 1B:
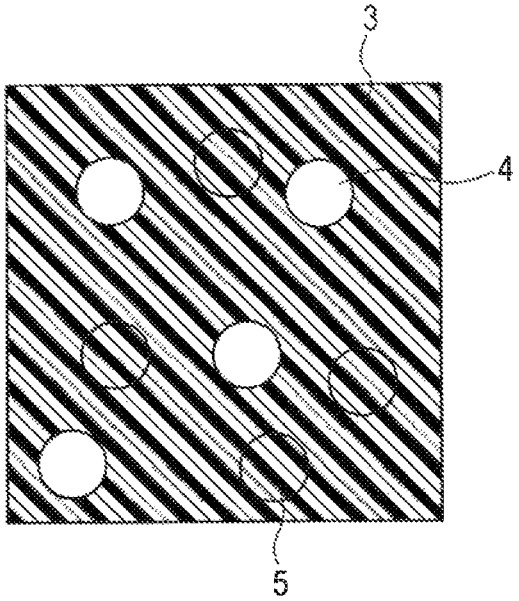
FIG. 1B is an enlarged front view illustrating a schematic configuration of the developing roller according to one aspect of the present invention.

FIG. 1A is a cross-sectional view in a direction orthogonal to the longitudinal direction of developing roller 1 according to the present aspect. FIG. 1B is a front view of the developing roller 1. As illustrated in FIGS. 1A and 1B, the developing roller 1 includes substrate 2, electro-conductive elastic layer 3 on the substrate 2, and a plurality of insulating domains 4 on the electro-conductive elastic layer 3. The insulating domains 4 respectively form protrusions on the surface of the developing roller 1. The electro-conductive elastic layer 3 has protrusions 5 in an exposed portion thereof uncovered with the insulating domains 4. In short, the surface of the developing roller 1 has protrusions constituted by the insulating domains 4 and protrusions constituted by the electro-conductive elastic layer.

The developing roller according to the present aspect possesses an excellent toner conveying ability and is also capable of suppressing reduction in image quality caused by uneven development. The present inventors have presumed the reason therefor as follows.

Figure 2A:
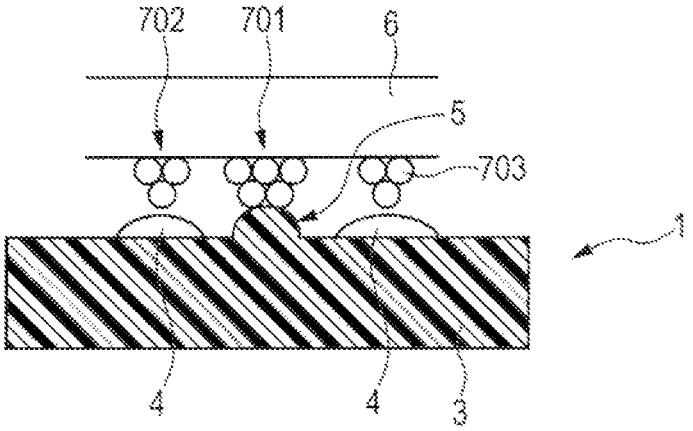
FIG. 2A is an illustrative view of a mechanism underlying the exertion of the effect of the developing roller according to one aspect of the present invention and illustrates a state immediately after movement of toner on the developing roller to a photosensitive member.

FIG. 2A schematically illustrates a state in a development region immediately after toner particles carried on the surface of the developing roller 1 are attached to an electrostatic latent image on photosensitive member 6.

As illustrated in FIG. 2A, a larger number of a toner particle 703 are attached to portion 701, of the photosensitive member 6, facing the exposed portion of the electro-conductive elastic layer 3 uncovered with the insulating domains 4 of the developing roller, as compared with portion 702 facing the insulating domain 4. Thus, so-called uneven development occurs.

Figure 2B:
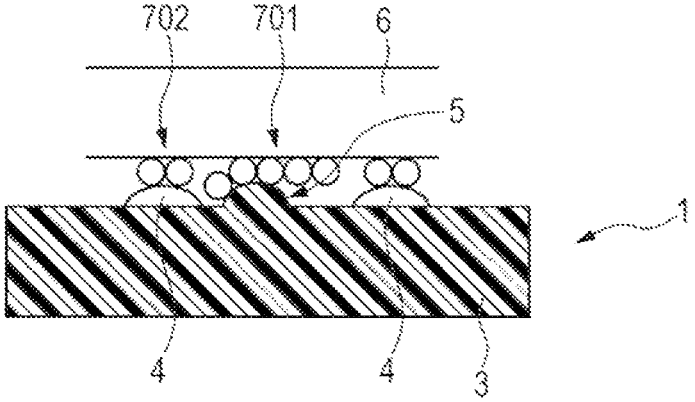
FIG. 2B is an illustrative view of a mechanism underlying the exertion of the effect of the developing roller according to one aspect of the present invention and illustrates a state where the toner attached to the photosensitive member is relocated.

Unlike the insulating domains 4, the protrusions 5 are hardly charged. Therefore, in a developing step, the protrusions 5 in the developing roller approach and eventually come in contact with the surface of the photosensitive member. In this process, as illustrated in FIG. 2B, the toner lump attached to the portion 701, on the surface of the photosensitive member 6, facing the exposed portion of the electro-conductive elastic layer 3 is mechanically disintegrated by the protrusions 5 without having much electric action on the toner particle, so that the toner is relocated. As a result, it is considered that uneven development is suppressed, and a high-quality electrophotographic image can be formed.

From the mechanism described above, it can be understood that when the developing roller and the photosensitive member are different in terms of circumferential velocity, the action of disintegrating the toner lump by the protrusions 5 works more favorably.

The developing roller has an Asker C hardness of 50 degrees or more and 90 degrees or less. Within such a hardness range, it is considered that the optimum hardness range for contact with the photosensitive member is attained, and uneven development can be eliminated by disintegrating the toner lump while suppressing deterioration in toner. When the Asker C hardness of the developing roller is 50 degrees or more and 90 degrees or less, it is considered that the developing nip width with respect to the longitudinal direction of the developing roller can be uniform, and the relocation of toner by rolling in the longitudinal direction of the developing roller can be performed uniformly. It is considered that the toner relocation may be performed by a unit other than the protrusions of the electro-conductive elastic layer, but is performed more effectively in the presence of the protrusions.

The insulating domains form protrusions on the surface of the developing roller. When a discharge wire is disposed substantially parallel to the longitudinal direction of the developing roller and at a position 1 mm apart from the surface of the developing roller and a direct-current voltage of 8 kV is applied between the developing roller and the discharge wire to charge the surface of the developing roller in an environment of a temperature of 23° C. and a relative humidity of 50%, a surface potential of the insulating domains corresponding to the completion of discharge is 10 V or more and 100 V or less. When a surface potential of the insulating domains falls within the range described above, the insulating domains are charged even during use of the developing roller in an electrophotographic image forming apparatus. Therefore, toner conveying performance can be secured after use over a long period.

The electro-conductive elastic layer has protrusions and has a surface potential of 2 V or less measured in the same way as in the insulating domains. When this surface potential is 2 V or less, the toner mass formed by the insulating domains is relocated by mechanically disintegrating the toner mass or by rolling the toner. Thus, uneven development can be suppressed.

The surface potentials described above are measured as follows. The measurement apparatus is a corona discharge apparatus, and DRA-2000L (trade name, manufactured by Quality Engineering Associates Inc. (QEA)) is used. This apparatus is provided with a head having a corona discharger integrated with a probe of a surface potentiometer and can move the head while performing corona discharge.

First, a master made of stainless steel (SUS403) having the same outer diameter as that of the developing roller is placed in the apparatus, and this master is shunted to an earth. Subsequently, the distance between the surface of the master and the probe of the surface potentiometer is adjusted to 0.76 mm, and the surface potentiometer is calibrated to zero. After the calibration, the master is detached, and the developing roller to be measured is placed in the apparatus. For charging conditions, the bias of the corona discharger is set to +8 kV, and the moving speed of a scanner is set to 400 mm/sec. Under these conditions, the developing roller is charged.

Next, the surface potentials can be measured by the following operation using an atomic force microscope (AFM), for example, "LensAFM" (trade name, manufactured by Nanosurf AG). A cantilever is forced to oscillate at frequency ωr. At the same time therewith, alternating-current voltage Vac with frequency ω and certain direct-current voltage Voff are applied to between the cantilever and the developing roller through the use of a signal generator WF1973 (manufactured by NF Corp.). The output signal from the cantilever contains a frequency or component and a frequency ω component that depends on the difference in potential between the cantilever and the developing roller. First, a phase component of ωr is isolated using a 2-MHz Wide Bandwidth DSP Lock-in Amplifier model 7280 (manufactured by AMETEK, Inc.). Then, an amplitude component of the ω component is isolated using another 2-MHz Wide Bandwidth DSP Lock-in Amplifier model 7280 (manufactured by AMETEK, Inc.). The direct-current voltage Voff at which this amplitude component becomes the smallest value is determined and used as the potential. The cantilever used is a Tipless Cantilever (resonance frequency: 75 kHz) manufactured by NanoWorld. For the arrangement of the cantilever and the developing roller, the distance from the tip of the cantilever to the central portion of the developing roller is adjusted to 13 μm, and the distance in the height direction from the tip of the cantilever to the developing roller is adjusted to 15 μm, when viewed from above.

Since this potential attenuates with time, time-dependent change in potential is measured and subjected to fitting by the least square method using the expression given below to calculate initial potential $V_0$. The value $V_0$ is used as the potential corresponding to the completion of discharge. $V=V_0\exp(-\alpha\times\sqrt{t})+\text{Const}$. This calculation is carried out by measuring V at 30 seconds, 1 minute, 5 minutes and 10 minutes after the completion of discharge. In this context, t represents time, and α represents a predetermined constant.

The measurement described above is carried out for the protrusions of the insulating domains and the electro-conductive elastic layer to calculate $V_0$ of each measurement portion. This operation is performed at 9 points for each measurement portion, and an average value thereof is used as the surface potential of each measurement portion.

Hereinafter, members constituting the developing roller of the present invention, etc., will be described in detail.

[Substrate]

The substrate has electro-conductivity and has the function of supporting the electro-conductive elastic layer disposed thereon. Examples of the material therefor can include: metals such as iron, copper, aluminum and nickel; and alloys containing these metals, such as stainless steel, duralumin, brass and bronze. The surface of the substrate can be plated without impairing the electro-conductivity, for the purpose of imparting scratch resistance thereto. Alternatively, the substrate used may be a resin base material surface-coated with a metal to have surface electro-conductivity or may be produced from an electro-conductive resin composition.

[Insulating Domain]

The volume resistivity of the insulating domains can be $1\times10^{13}$ Ω·cm or more and $1\times10^{17}$ Ω·cm or less, particularly, $1\times10^{14}$ Ω·cm or more and $1\times10^{17}$ Ω·cm or less, because the insulating domains are more easily charged.

Examples of the constituent material for the insulating domains include a resin and a metal oxide. Particularly, the constituent material can be a resin which is more easily chargeable.

Specific examples of the resin include an acrylic resin, a polyolefin resin, an epoxy resin and a polyester resin.

Particularly, the resin can be an acrylic resin because the volume resistivity of the domains can be easily adjusted to within the range described above. Specific examples of the acrylic resin include a polymer and a copolymer prepared from the following monomers as starting materials: methyl methacrylate, 4-tert-butylcyclohexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, and ethoxylated bisphenol A diacrylate.

Examples of the method for forming the insulating domains in a protruding shape include a method which involves applying the constituent material for the insulating domains onto the electro-conductive elastic layer using various printing methods to form the insulating domains having a protruding shape. Specifically, a jet dispenser method, an inkjet method and a spray method can be used for forming a plurality of insulating domains on the surface of the electro-conductive elastic layer.

The size of the insulating domains is preferably a diameter of 10 μm or more from the viewpoint of toner conveying ability and is preferably a diameter of 100 μm or less from the viewpoint of image quality. The diameter is more preferably 30 μm or more and 70 μm or less. The arrangement density of the insulating domains is preferably 10 or more and 1000 or less domains, more preferably 50 or more and 300 or less domains, per $mm^2$ from the viewpoint of toner conveying ability. The height of the insulating domains is preferably 1.0 μm or more and 15.0 μm or less, more preferably 3.0 μm or more and 8.0 μm or less, from the viewpoint of toner conveying ability. The diameter, the height and the arrangement density of the insulating domains can be measured by observation under a laser microscope (trade name: VK-8700, manufactured by Keyence Corp.) using a ×50 objective lens. The observation image obtained with the laser microscope is subjected to slant correction as follows. The slant correction is performed on the quadratic surface correction mode. The insulating domains within the image are measured. In this respect, an arithmetic average of horizontal Feret diameters and vertical Feret diameters in the field of view is used as the diameter. As for the height, the difference between the uppermost point and the lowermost point of each insulating domain is used as the height. Arbitrary 10 insulating domains are observed, and an arithmetic average value of the obtained values is adopted as the height value. The arrangement density is obtained as an average value of arbitrary 10 points in the observation image.

[Electro-Conductive Elastic Layer]

The electro-conductive elastic layer contains an elastic material such as a resin or a rubber. Specific examples of the resin and the rubber include a polyurethane resin, a polyamide, a urea resin, a polyimide, a melamine resin, a fluorine resin, a phenol resin, an alkyd resin, a silicone resin, a polyester, an ethylene-propylene-diene copolymer (EPDM) rubber, an acrylonitrile-butadiene rubber (NBR), an chloroprene rubber (CR), a natural rubber (NR), an isoprene rubber (IR), a styrene-butadiene rubber (SBR), a fluorine rubber, a silicone rubber, an epichlorohydrin rubber and an NBR hydride. Particularly, a polyurethane resin can be used because of being excellent in frictional charging performance for toner, facilitating obtaining the chance to come in contact with toner owing to excellent flexibility, and having abrasion resistance. When the electro-conductive elastic layer is configured such that two or more layers are laminated, a polyurethane resin can be used as the outermost electro-conductive elastic layer. Examples of the polyurethane resin include an ether-based polyurethane resin, an ester-based polyurethane resin, an acrylic-based polyurethane resin and a carbonate-based polyurethane resin. Particularly, a polyether polyurethane resin can be used because of facilitating rolling toner owing to moderate frictional performance with toner, and facilitating disintegrating the toner mass owing to flexibility.

The polyether polyurethane resin can be obtained through the reaction between a polyether polyol and an isocyanate compound known in the art. Examples of the polyether polyol include polyethylene glycol, polypropylene glycol and polytetramethylene glycol. These polyol components may each be converted in advance to a prepolymer chain-extended with an isocyanate such as 2,4-tolylene diisocyanate, 2,6-tolylene diisocyanate (TDI), diphenylmethane diisocyanate (MDI) or isophorone diisocyanate (IPDI), if necessary.

Examples of the isocyanate compound that is reacted with the polyol component include, but are not particularly limited to: aliphatic polyisocyanates such as ethylene diisocyanate and 1,6-hexamethylene diisocyanate (HDI); alicyclic polyisocyanates such as isophorone diisocyanate (IPDI), cyclohexane 1,3-diisocyanate and cyclohexane 1,4-diisocyanate; aromatic polyisocyanates such as 2,4-tolylene diisocyanate, 2,6-tolylene diisocyanate (TDI) and diphenylmethane diisocyanate (MDI); and modified products or copolymers of these polyisocyanates, and block compounds thereof.

When the electro-conductive elastic layer is configured such that two or more layers are laminated, the material constituting the electro-conductive elastic layer on the substrate can be a silicone rubber. Examples of the silicone rubber can include a polydimethylsiloxane, a polymethyltrifluoropropylsiloxane, a polymethylvinylsiloxane, a polyphenylvinylsiloxane and copolymers of these siloxanes. These resins and rubbers can each be used alone or can be used in combination of two or more according to the need. The resin and rubber materials can be identified by measuring the electro-conductive elastic layer using a Fourier transform infrared spectrophotometer.

[Electro-Conductive Agent]

In order to set the surface potential of the exposed portion of the electro-conductive elastic layer to 2 V or less, the electro-conductive elastic layer can contain an electro-conductive agent. Examples of the electro-conductive agent include ionic conductive agents and electronic conductive agents such as carbon black. Particularly, carbon black can be used because the carbon black can control the electro-conductivity of the electro-conductive elastic layer and the toner charging performance of the electro-conductive elastic layer. The volume resistivity of the electro-conductive elastic layer can be in the range of $1\times10^3$ Ω·cm or more and $1\times10^{11}$ Ω·cm or less, particularly, $1\times10^4$ Ω·cm or more and $1\times10^8$ Ω·cm or less.

Specific examples of the carbon black can include: electro-conductive carbon black such as "Ketjenblack" (trade name, manufactured by Lion Specialty Chemicals Co., Ltd.) and acetylene black; and carbon black for rubber such as SAF (super abrasion furnace), ISAF (intermediate SAF), HAF (high abrasion furnace), FEF (fast extruding furnace), GPF (general purpose furnace), SRF (semi-reinforcing furnace), FT (fine thermal) and MT (medium thermal). In addition, oxidized carbon black for color ink or pyrolytic carbon black can be used. The amount of the carbon black added can be 5 parts by mass or more and 50 parts by mass or less with respect to 100 parts by mass of the resin or the rubber. The content of the carbon black in the electro-conductive elastic layer can be measured by using a thermogravimetric analysis (TGA) apparatus.

Examples of the method for measuring the volume resistance values of the insulating domains and electro-conductive elastic layer from the developing roller include a method as described below.

An insulating domain region and an electro-conductive elastic layer region are each cut out of the developing roller, and a thin section sample having a planar size of 50 μm square and thickness t of 100 nm is prepared therefrom by using a microtome. Next, this thin section sample is placed on a flat metal plate and pressed thereagainst from above by using a metal terminal having a pressing surface area S of 100 $\mu m^2$. In this state, resistance R is determined by applying a voltage of 10 V to between the metal terminal and the flat metal plate with an electrometer 6517B manufactured by Keithley Instruments, Inc. From this resistance R, volume resistivity $\rho_v$ (Ω·cm) is calculated according to the following formula (1).

$$\rho_v = R \times S/t \qquad \text{Formula (1)}$$

In addition to the carbon black, examples of the electro-conductive agent that may be used can include: graphites such as natural graphite and artificial graphite; powders of metals such as copper, nickel, iron and aluminum; powders of metal oxides such as titanium oxide, zinc oxide and tin oxide; and electro-conductive polymers such as polyaniline, polypyrrole and polyacetylene. These electro-conductive agents can each be used alone or can be used in combination of two or more according to the need.

[Asker C Hardness]

The Asker C hardness measured on the surface of the developing roller according to the present aspect is 50 degrees or more and 90 degrees or less. When the hardness falls within the numerical range, deterioration in toner particle can be suppressed in the contact development of an electrostatic latent image on the photosensitive member while the toner on the photosensitive member can be relocated. When the hardness falls within the numerical range described above, the developing nip width with respect to the longitudinal direction of the developing roller can be uniform, and the relocation of toner by rolling in the longitudinal direction of the developing roller can be performed uniformly.

The Asker C hardness can be measured in an environment of a temperature of 23° C. and a relative humidity of 55% using a type C hardness meter (Asker C spring type rubber hardness meter, manufactured by Kobunshi Keiki Co., Ltd.) described in Japan Industrial Standard (JIS) K 7312-1996. The hardness meter is brought into contact under force of 10 N with the developing roller which has left for 12 hours or longer in an environment of a temperature of 23° C. and a relative humidity of 55%. The value obtained 30 seconds thereafter is used as a measurement value. The measurement positions are a total of 9 sites: 3 sites in the circumferential direction (interval with an angle of 120°) for each of the central portion in the longitudinal direction of the developing roller and positions of 90 mm from the central portion toward both ends. An arithmetic average value of the measurement values at these 9 sites is used as the Asker C hardness.

The thickness of the electro-conductive elastic layer can be 0.4 mm or more and 5 mm or less because the Asker C hardness can easily fall within the range of the present invention without being influenced by the substrate. The thickness of the electro-conductive elastic layer can be determined by the observation and measurement of the cross section under an optical microscope. A silicone rubber or a polyurethane resin can be used as a material for the electro-conductive elastic layer because the Asker C hardness of the developing roller can easily fall within the range of the present invention.

[Protrusion of Electro-Conductive Elastic Layer]

The surface of the developing roller includes an exposed portion of the electro-conductive elastic layer, the exposed portion being uncovered with the insulating domains. The exposed portion of the electro-conductive elastic layer has protrusions (reference numeral 5 in FIGS. 1A and 1B).

[Area Ratio of Protrusion]

In the developing roller according to the present aspect, the protrusions at the exposed portion have a particular area ratio. Specifically, the developing roller has a length L of 200 mm or more in a longitudinal direction orthogonal to the circumferential direction thereof. Provided that a nip region having a nip width of 1.0 mm and an area of 1.0 mm×L mm is demarcated by pressing the surface of the developing roller against a flat glass plate, assuming that a square region of 0.3 mm on a side (area: 0.09 $mm^2$) is placed in the nip region, and total sum of areas of the contacted portions between the exposed portion of the electro-conductive elastic layer uncovered with the insulating domains and the flat glass plate in the square region is defined as "exposed portion is defined as "$S_T$" $mm^2$, a percentage ratio of $S_T$ to the area 0.09 $mm^2$ of the square region, $100*S_T/0.09$, is 0.50% or more and 10.00% or less.

Hereinafter, "$S_T$", i.e. the total sum of areas of the contacted portions, is referred to as a "protrusion contact area" in some cases, and the percentage ratio "$100*S_T/0.09$" is referred to as a "protrusion contact rate" in some cases.

If the "$100*S_T/0.09$" value is less than 0.50%, the relocation of a toner layer by the exposed portion of the electro-conductive elastic layer may be inadequate so that toner concentration unevenness slightly remains during development, resulting in image roughness. If the "$100S_T/0.09$" value exceeds 10.00%, the relocation of toner may be increased too much, resulting in streakiness in images.

The "$100*S_T/0.09$" value can be 1.00% or more and 5.00% or less because the rolling or relocation of toner by the exposed portion of the electro-conductive elastic layer is easily achieved and toner concentration unevenness can be further eliminated.

Figure 3:
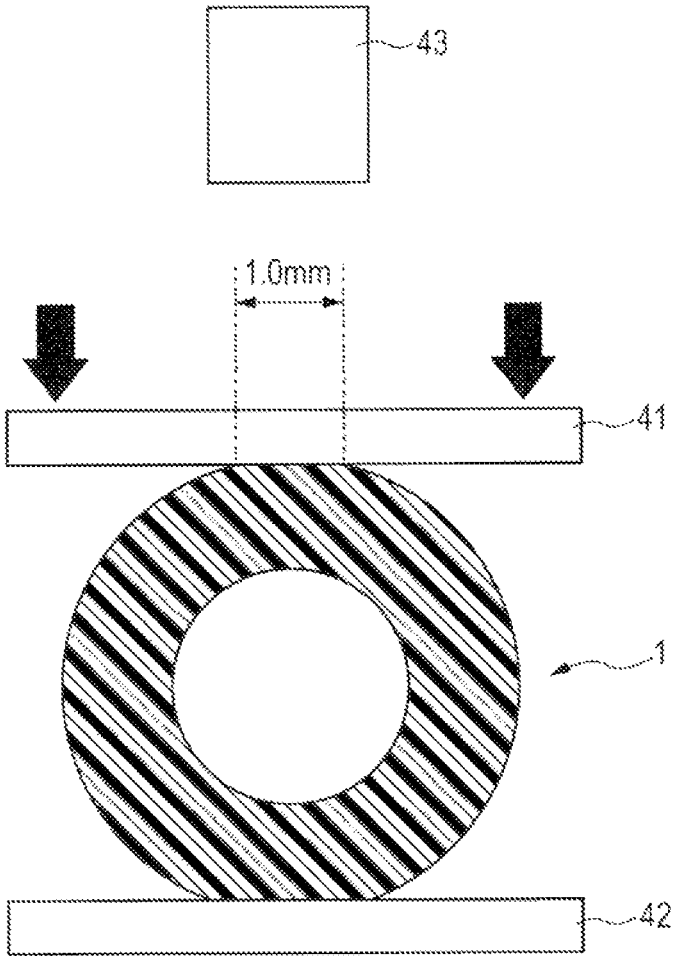
FIG. 3 is an illustrative view of an evaluation apparatus for the developing roller.

The $S_T$ value is measured as follows. The flat glass plate used is, for example, a flat glass plate having a material of BK7, surface accuracy of optically polished faces on both sides, parallelism of within 1 minute and a thickness of 2 mm. A tool having stage 42, flat glass plate 41 and microscope 43 illustrated in FIG. 3 is used. The stage is flat and smooth and is capable of fixing the developing roller horizontally. The flat glass plate is movable upward and downward. The nip width formed by pressing the developing roller downward can be measured with the microscope 43. The outermost portions at which the surface of the developing roller and the flat glass plate come in contact with each other are defined as nip ends. The distance between both of the nip ends (reference numeral 44 in FIG. 4) is used as the nip width. The regions serving as the outermost portions on the surface of the developing roller may be positioned at either of the electro-conductive elastic layer or the insulating domains.

The flat glass plate is moved downward toward the developing roller fixed on the stage, and the flat glass plate (material: BK7, surface accuracy: optically polished faces on both sides, parallelism: within 1 minute) having a width of 50 mm, a length of 250 mm and a thickness of 2 mm is pressed against the developing roller such that the nip width is 1.0 mm.

In this operation, the contact face between the developing roller and the flat glass plate is observed from the flat glass plate side by using a video microscope (trade name: DIGITAL MICROSCOPE VHX-500, manufactured by Keyence Corp.) at an observation magnification of ×200 to adjust the nip width.

Figure 4:
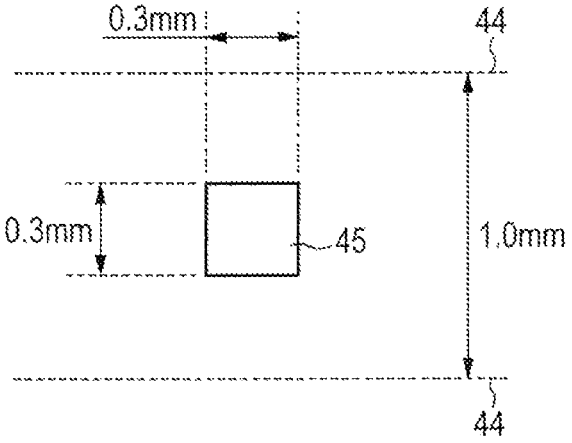
FIG. 4 is an illustrative view of an evaluation method for the developing roller.

Next, as illustrated in FIG. 4, a square of 0.3 mm on a side at the center of the obtained image is used as observation area 45. The total contact area between the exposed portion of the electro-conductive elastic layer and the flat glass plate within the observation area is measured. In this operation, the observation magnification of the microscope is set to ×500. In addition, the incident angle of observation light is set to an angle of 90° (right lateral direction) with respect to the normal direction of the flat plate surface. The angle of the observation light can be adjusted to this angle to thereby darken only the contacted regions with the flat glass plate in the observation image of the surface of the developing roller.

Figure 5:
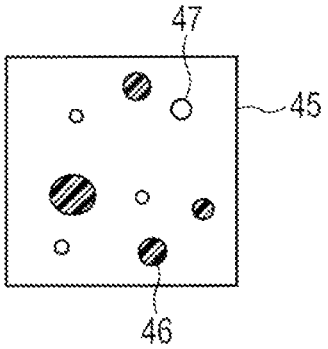
FIG. 5 is a view illustrating one example of results of evaluation of the developing roller.

Next, as illustrated in FIG. 5, only contacted regions 46 formed between the exposed portion of the electro-conductive elastic layer of the developing roller and the flat glass plate (hereinafter, these regions are referred to as "protrusion contact regions" in some cases) are extracted by using an image analysis software ("Image-Pro Plus" (trade name, manufactured by Media Cybernetics, Inc.) and binarized. The sum of area of the contacted regions within the observation area is defined as $S_T'$ $mm^2$. Reference numeral 47 in FIG. 5 denotes contacted regions formed between the surfaces of the insulating domains and the flat glass plate. This measurement is carried out at a total of 9 sites: 3 sites in the circumferential direction (interval with an angle of 120°) for each of the central portion in the longitudinal direction of the developing roller and positions of 90 mm from the central portion toward both ends. An average value of the areas $S_T'$ $mm^2$ at these 9 sites is used as $S_T$ (protrusion contact area) $mm^2$.

The methods for binarization and area calculation using "Image-Pro Plus" are carried out as follows.

"Count/Size" and "Option" are selected in this order from "Measure" in the tool bar, and binarization conditions are established. 8-Connect is selected in object extract options, and Smoothing is set to 0. In addition, Pre-Filter, Fill Holes, and Convex Hull are not selected, and "Clean Borders" is set to "None". "Measurements" are selected from "Measure" in the tool bar, 2 to 107 are input in Filter Ranges for Area.

Next, Rectangle ROI is selected from "Measure" in the tool bar and prepared to include the contacted regions 46 formed between the exposed portion of the electro-conductive elastic layer and the flat glass plate, followed by binarization by "Automatic Dark Objects". Area can be obtained on a pixel basis by selecting "Measurement Data" from "Display" in the tool bar. Subsequently, the area of each contacted region 46 is obtained from the relationship with the length at 1 pixel of the observation image. In this way, the areas of all of the contacted regions 46 in the observation area are measured and added up to obtain $S_T'$ $mm^2$.

In order to set the "$100*S_T/0.09$" (protrusion contact rate) value to 0.50% or more and 10.00% or less, the electro-conductive elastic layer can contain a roughening particle so that protrusions derived from the roughening particle are formed on the surface of the electro-conductive elastic layer. Average particle size $D_{50}$ of the roughening particle can be 1 μm or more and 30 μm or less.

The particle sizes of the roughening particle can be measured by a scanning electron microscope while the cross sections are cut by FIB using a FIB-SEM crossbeam apparatus (NVision 40; manufactured by Carl Zeiss AG). The average particle size $D_{50}$ can be determined based on the measured particle sizes. The amount of the roughening particle in the electro-conductive elastic layer can be 1% by mass or more and 50% by mass or less with respect to the resin or the rubber as the matrix of the electro-conductive elastic layer.

A fine particle of a polyurethane resin, a polyester resin, a polyether resin, a polyamide resin, an acrylic resin, a polycarbonate resin or the like can be used as the roughening particle. Among these particles, a polyurethane resin particle is flexible and therefore, can further facilitate adjusting the protrusion contact rate of the electro-conductive elastic layer to within the range of 0.50% or more and 10.00% or less.

The electro-conductive elastic layer can be prepared as two or more layers, and the outermost electro-conductive elastic layer can contain the particle. In this respect, the film thickness of the outermost electro-conductive elastic layer can be 5 μm or more and 15 μm or less. The electro-conductive elastic layer of the present invention can be formed by a method such as dip coating or spray coating.

In order to set the "100*$S_T$/0.09" (protrusion contact rate) value to 0.50% or more and 10.00% or less, this value can also be controlled by the height of the insulating domains and the arrangement intervals of the insulating domains. The insulating domains having a substantially hemispherical shape can have a height of 2.0 μm or more and 13.0 μm or less and an arrangement interval of 75 μm or more and 150 μm or less.

[Density of Protrusion of Electro-Conductive Elastic Layer]

The arrangement density of the protrusions is preferably 5 or more and 5000 or less protrusions, more preferably 250 or more and 1500 or less protrusion, per $mm^2$ from the viewpoint of toner relocation.

[Horizontal Feret Diameter R]

The "protrusion contact regions" of the electro-conductive elastic layer are regions where the developing roller and the photosensitive member are located nearest in the developing nip between the developing roller and the photosensitive member. According to the studies of the present inventors, the largest value of lengths (which are the respective sizes of the "protrusion contact regions" of the electro-conductive elastic layer) in a direction parallel to the longitudinal direction of the developing roller is used as the "horizontal Feret diameter R". When this "horizontal Feret diameter R" is set to a value within a predetermined range, an uneven amount of toner attached to the photosensitive member can be more easily eliminated.

The horizontal Feret diameter R can be 1.0 μm or more and 15.0 μm or less. When the horizontal Feret diameter R is 1.0 μm or more, this facilitates rolling or rearranging toner by the protrusions of the electro-conductive elastic layer in the developing nip and facilitates eliminating toner concentration unevenness. When the horizontal Feret diameter R is 15.0 μm or less, this facilitates eliminating toner concentration unevenness in the longitudinal direction of the developing roller.

Figure 6:
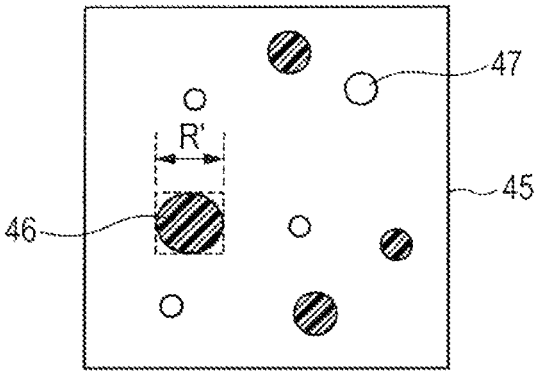
FIG. 6 is a view illustrating another example of results of evaluation of the developing roller.

The horizontal Feret diameter R is measured as follows. The observation image obtained in the $S_T$ measurement described above is used to measure the "protrusion contact regions" of the electro-conductive elastic layer within the image. In this operation, as illustrated in FIG. 6, a rectangle circumscribing each "protrusion contact region" is drawn such that one side thereof is parallel to the longitudinal direction of the developing roller. The largest value of lengths of such sides is defined as horizontal Feret diameter R'. This measurement is carried out for 9 sites in the developing roller in the same way as in the $S_T$ measurement. An arithmetic average value of the obtained values is used as the horizontal Feret diameter R. In this respect, the "protrusion contact regions" to be measured are "protrusion contact regions" completely included in a square area of 0.3 mm on a side, and the "protrusion contact regions" that are not completely included therein are not the regions to be measured.

In order to set the horizontal Feret diameter R to 1.0 μm or more and 15.0 μm or less, the average particle size $D_{50}$ of the particles contained in the electro-conductive elastic layer can be 1 μm or more and 30 μm or less. Alternatively, the electro-conductive elastic layer is configured as two or more layers, the outermost layer of which can contain the particle and have a film thickness of 5 μm or more and 30 μm or less.

[Area Ratio of Exposed Portion]

For the developing roller, assuming that a square region of 0.3 mm on a side is placed on the surface of the developing roller, and an area of the exposed portion of the electro-conductive elastic layer in the square region, is defined as "$S_E$" $mm^2$, a percentage ratio of $S_E$ to the area of the square region, i.e. "100*$S_E$/0.09" may preferably be 60% or more and 90% or less. Hereinafter, the percentage ratio, "100*$S_E$/0.09", is referred to as an "exposure rate" in some cases.

When the "exposure rate" is 60% or more and 90% or less, toner located in proximity to the exposed portion of the electro-conductive elastic layer can be more easily rearranged. The resulting electrophotographic image can have higher quality.

The "exposure rate" is measured as follows. The developing roller is observed with a video microscope (trade name: DIGITAL MICROSCOPE VHX-500, manufactured by Keyence Corp.). The observation magnification is set to ×500. A square of 0.3 mm on a side is used as an observation area, and the exposed region of the electro-conductive elastic layer within the observation area is measured. Only the exposed portion of the electro-conductive elastic layer uncovered with the insulating domains of the developing roller is extracted using image analysis software (Image-Pro Plus: trade name, manufactured by Media Cybernetics, Inc.) and binarized to determine the ratio of area $S_E'$ of the exposed portion within the observation area. This measurement is carried out at a total of 9 sites: 3 sites in the circumferential direction (interval with an angle of 120°) for each of the central portion in the longitudinal direction of the developing roller and positions of 90 mm from the central portion toward both ends. An average value of the areas $S_E'$ at these 9 sites is used as the area $S_E$ of the exposed portion. The $S_E$ value and the exposure rate can be controlled by the diameter and the arrangement density of the insulating domains.

[Relationship Between Protrusion of Exposed Portion of Electro-Conductive Elastic Layer and Height of Insulating Domain]

Difference Rz−H (μm) of ten-point average roughness Rz (μm) of the exposed portion of the electro-conductive elastic layer from height H (μm) of the insulating domains can be 0 μm or more and 10 μm or less from the viewpoint of toner conveying performance and relocation. The Rz (μm) of the exposed portion of the electro-conductive elastic layer is measured by a laser microscope (VK-8700, manufactured by Keyence Corp.) using a ×50 objective lens. The ten-point average roughness of an arbitrary region of 50 μm square where only the electro-conductive elastic layer is exposed is measured at 10 sites, and an arithmetic average value thereof is used as the Rz.

[Additive]

The electro-conductive elastic layer can additionally contain a charge controlling agent, a lubricant, a filler, an antioxidant, an antiaging agent and the like without inhibiting the functions of the resin or the rubber and the electro-conductive agent described above.

[Electrophotographic Image Forming Apparatus]

Figure 7:
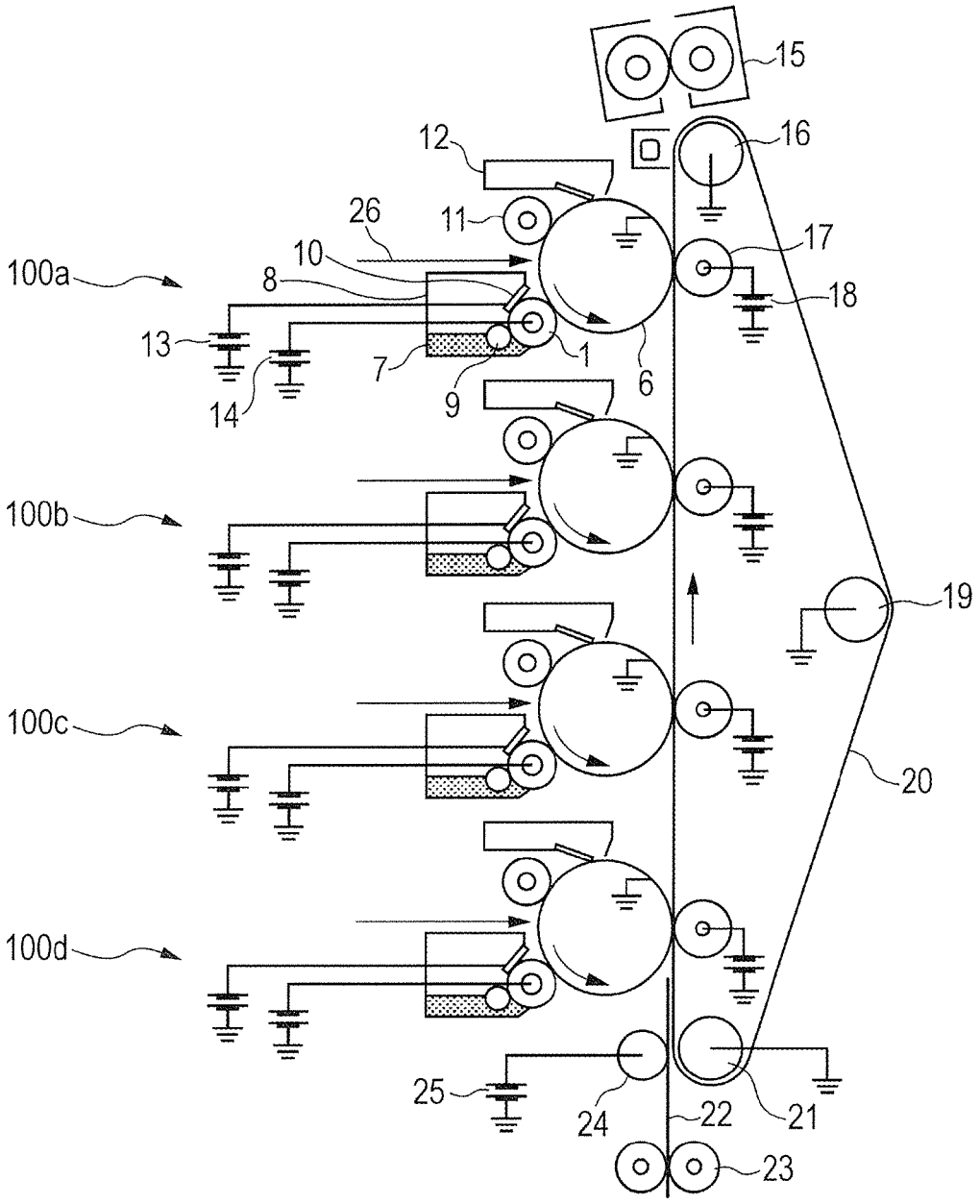
FIG. 7 is a schematic view of the electrophotographic image forming apparatus according to one aspect of the present invention.

The electrophotographic image forming apparatus is an image forming apparatus including an image bearing member which carries an electrostatic latent image, a charging apparatus which charges the image bearing member, an exposure apparatus which forms an electrostatic latent image on the charged image bearing member, a developing apparatus which develops the electrostatic latent image with toner to form a toner image, and a transfer apparatus which transfers the toner image to a transfer material, the developing apparatus having the developing roller of the present invention. One example of the electrophotographic image forming apparatus of the present invention is illustrated in FIG. 7. In FIG. 7, image forming units 100*a* (for yellow), 100*b* (for magenta), 100*c* (for cyan) and 100*d* (for black) are disposed for respective colors of toner: yellow toner, magenta toner, cyan toner and black toner. Each of the image forming units 100*a* to 100*d* is provided with photosensitive member 6 as an electrostatic latent image bearing member which rotates in the direction indicated by the arrow. The neighborhood of each photosensitive member 6 is provided with charging apparatus 11 for uniformly charging the photosensitive member 6, an exposure unit (not shown) which irradiates the uniformly charged photosensitive member 6 with laser light 26 to form an electrostatic latent image, and developing apparatus 8 which feeds toner to the photosensitive member 6 with the formed electrostatic latent image to develop the electrostatic latent image.

On the other hand, transfer conveying belt 20 which conveys recording material 22 such as paper fed by paper feed roller 23 is suspended on driving roller 16, driven roller 21 and tension roller 19. The charge of adsorption bias power source 25 is applied to the transfer conveying belt 20 via adsorption roller 24 so that the transfer conveying belt conveys the recording material 22 electrostatically attached to the surface of the belt. Transfer bias power source 18 which applies charge for transferring the toner image on the photosensitive member 6 of each of the image forming units 100*a* to 100*d* to the recording material 22 conveyed by the transfer conveying belt 20 is disposed therein. The transfer bias is applied via transfer roller 17 disposed on the back side of the transfer conveying belt 20. Each color toner image formed by each of the image forming units 100*a* to 100*d* is sequentially transferred in a superimposed manner onto the recording material 22 conveyed by the transfer conveying belt 20 rotary-driven in synchronization with each of the image forming units 100*a* to 100*d*. The color electrophotographic image forming apparatus is further provided with fixing apparatus 15 which fixes the toner image transferred in a superimposed manner on the recording material 22, by heating or the like, and a conveying apparatus (not shown) which discharges the recording material 22 with the formed image to the outside of the apparatus.

Each image forming unit is provided with cleaning apparatus 12 having a cleaning blade which cleans the surface of each photosensitive member 6 by removing a transfer residual toner remaining on the photosensitive member 6 and not being transferred. The cleaned photosensitive member 6 is on standby in an image formable state. The developing apparatus 8 disposed in each of the image forming units is provided with a developer container which accommodates nonmagnetic developer (toner) 7 as a one-component developer, and the developing roller 1 which is placed to cover the opening of the developer container and faces the photosensitive member 6 at a portion exposed from the developer container. Developer feed roller 9 which feeds the toner 7 to the developing roller 1 simultaneously with scraping off the unused toner 7 remaining on the developing roller 1 after development is disposed in the developer container. In addition, developer amount regulating member 10 which forms a thin film of the toner 7 on the developing roller 1 while frictionally charging the toner is disposed in the developer container. These members are each disposed in contact with the developing roller 1, and the developing roller 1 and the developer feed roller 9 rotate in the forward direction. Development bias that develops the toner 7 on the developing roller 1 onto the photosensitive member 6 is applied to the developing roller 1 by developer roller bias power source 14. Bias that injects charge to the toner 7 on the developing roller 1 is applied to the developer amount regulating member 10 by developer amount regulating member power source 13.

[Electrophotographic Process Cartridge]

Figure 8:
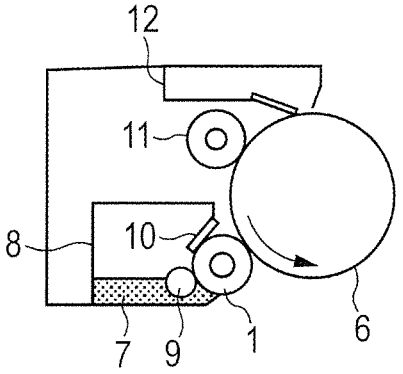
FIG. 8 is a schematic view of the electrophotographic process cartridge according to one aspect of the present invention.

The electrophotographic process cartridge has the developing roller of the present invention and is configured to be detachably attachable to a body of an electrophotographic image forming apparatus. One example of the electrophotographic process cartridge of the present invention is illustrated in FIG. 8. The electrophotographic process cartridge illustrated in FIG. 8 has developing apparatus 8, photosensitive member 6, charging apparatus 11 and cleaning apparatus 12, and these members are provided integrally and detachably attached to the body of the electrophotographic image forming apparatus. Examples of the developing apparatus 8 can include the same as that provided in the image forming unit described in the electrophotographic image forming apparatus. The electrophotographic process cartridge of the present invention may be a process cartridge having these members integrated with, for example, a transferring member which transfers a toner image on the photosensitive member 6 to the recording material 22.

As mentioned above, the developing roller according to one aspect of the present invention exhibits an excellent toner conveying ability and contributes to the stable formation of a high-quality electrophotographic image, even when used over a long period in a low-temperature and low-humidity environment. The process cartridge and the electrophotographic image forming apparatus according to one aspect of the present invention is capable of suppressing occurrence of defects of an electrophotographic image such as uneven density and roughness even in a low-temperature and low-humidity environment.

According to one aspect of the present invention, a developing roller which possesses excellent toner conveying ability and contributes to the formation of a high-quality electrophotographic image can be obtained. According to another aspect of the present invention, a process cartridge and an electrophotographic image forming apparatus which contribute to the stable formation of a high-quality electrophotographic image can be obtained.

EXAMPLES

Hereinafter, the present invention will be specifically described with reference to Production Examples and Examples.

[Production Example 1] Production of Elastic Roller K-1

A SUS304 mandrel having an outside diameter of 6 mm and a length of 270 mm was coated with a primer (trade name: DY35-051; manufactured by Dow Corning Toray Co., Ltd.) and baked, and the resultant was provided as a substrate. This substrate was placed in a mold, and an addition-type silicone rubber composition prepared by mixing the materials shown in Table 1 below was injected to a cavity formed in the mold. Subsequently, the mold was heated to thermally cure the silicone rubber composition at a temperature of 150° C. for 15 minutes, which was then detached from the mold. The curing reaction was completed by further heating at a temperature of 180° C. for 1 hour to produce elastic roller K-1 having an electro-conductive elastic layer having a thickness of 2.75 mm around the periphery of the substrate.

[Production Examples 2 to 5] Production of Elastic Rollers K-2 to K-5

Elastic rollers K-2 to K-5 were each produced in the same way as in Production Example 1 except that mandrels differing in outside diameter as shown in Table 1 were used. The numeric values in Table 1 represent part(s) by mass.

TABLE 1

| Material | Elastic roller | | | | |
|---|---|---|---|---|---|
| | K-1 | K-2 | K-3 | K-4 | K-5 |
| Liquid silicone rubber material (trade name: SE6724A/B; manufactured by Dow Corning Toray Co., Ltd.) | 100 | | | | |
| Carbon black (trade name: TOKABLACK #7360SB; manufactured by Tokai Carbon Co., Ltd.) | 20 | | | | |
| Platinum catalyst | 0.1 | | | | |
| Mandrel diameter (mm) | 6 | 5 | 10.5 | 3 | 11.3 |

[Production Example 11] Production of Coating Liquid D-1 for Electro-Conductive Elastic Layer The two types of materials shown in the column "Component 1" of Table 2 were added into 200 parts by mass of methyl ethyl ketone (MEK) and mixed. Subsequently, the mixture was reacted at a temperature of 80° C. for 4 hours in a nitrogen atmosphere to obtain a polyurethane polyol prepolymer. 100 parts by mass of this polyurethane polyol prepolymer and other materials shown in the column "Component 2" of Table 2 were added at the compounding ratio shown in Table 2 into 400 parts by mass of MEK (total solid content: 30% by mass) and dispersed by stirring with a ball mill to obtain a dispersion. This dispersion was used as coating liquid D-1 for electro-conductive elastic layer.

[Production Examples 12 to 27] Production of Coating Liquids D-2 to D-17 for Electro-Conductive Elastic Layer Coating liquids D-2 to D-17 were each produced in the same way as in Production Example 11 except that the materials shown in Table 2 were used. The numeric values in Table 2 represent part(s) by mass.

TABLE 2

| Component | Material | Coating liquid for electro-conductive elastic layer | | | | | | | | |
|---|---|---|---|---|---|---|---|---|---|---|
| | | D-1 | D-2 | D-3 | D-4 | D-5 | D-6 | D-7 | D-8 | D-9 |
| 1 | Polytetramethylene glycol (trade name: "PolyTHF", manufactured by BASF SE) | | | | | 100 | | | | |
| | Isocyanate (trade name: "Millionate MT" (MDI), manufactured by Tosoh Corp.) | | | | | 18 | | | | |
| 2 | Polyurethane polyol prepolymer | | | | | 100 | | | | |
| | Isocyanate (trade name: "Coronate T-80", manufactured by Tosoh Corp.) | | | | | 45 | | | | |
| | Polyether-modified silicone oil (trade name: "KF-6012", manufactured by Shin-Etsu Chemical Co., Ltd.) | 0.5 | 0.5 | 0.5 | 0.5 | 0.5 | 0 | 1 | 0.5 | 0.5 |
| | Urethane particle (trade name: "UCN-5070D", manufactured by Dainichiseika Color & Chemicals Mfg. Co., Ltd.) | 0 | 0 | 0 | 0 | 0 | 0 | 0 | 0 | 30 |
| | Urethane particle (trade name: "UCN-5150D", manufactured by Dainichiseika Color & Chemicals Mfg. Co., Ltd.) | 5 | 10 | 20 | 30 | 75 | 20 | 20 | 0 | 0 |
| | Urethane particle (trade name: "C-300 Transparent", manufactured by Negami Chemical Industrial Co., Ltd) | 0 | 0 | 0 | 0 | 0 | 0 | 0 | 0 | 0 |
| | Urethane particle (trade name: "C-200 Transparent", manufactured by Negami Chemical Industrial Co., Ltd) | 0 | 0 | 0 | 0 | 0 | 0 | 0 | 0 | 0 |
| | Acrylic particle (trade name: "MX-150", manufactured by Soken Chemical & Engineering Co., Ltd.) | 0 | 0 | 0 | 0 | 0 | 0 | 0 | 40 | 0 |
| | Acrylic particle (trade name: "MX-1500H", manufactured by Soken Chemical & Engineering Co., Ltd.) | 0 | 0 | 0 | 0 | 0 | 0 | 0 | 0 | 0 |
| | Carbon black (trade name: "MA100", manufactured by Mitsubishi Chemical Corp.) | 26 | 26 | 26 | 26 | 26 | 26 | 26 | 26 | 26 |

| Component | Material | Coating liquid for electro-conductive elastic layer | | | | | | | |
|---|---|---|---|---|---|---|---|---|---|
| | | D-10 | D-11 | D-12 | D-13 | D-14 | D-15 | D-16 | D-17 |
| 1 | Polytetramethylene glycol (trade name: "PolyTHF", manufactured by BASF SE) | | | | 100 | | | | |
| | Isocyanate (trade name: "Millionate MT" (MDI), manufactured by Tosoh Corp.) | | | | 18 | | | | |
| 2 | Polyurethane polyol prepolymer | | | | 100 | | | | |
| | Isocyanate (trade name: "Coronate T-80", manufactured by Tosoh Corp.) | | | | 45 | | | | |
| | Polyether-modified silicone oil (trade name: "KF-6012", manufactured by Shin-Etsu Chemical Co., Ltd.) | 0.5 | 0.5 | 0.5 | 0.5 | 0.5 | 0.5 | 5 | 0.5 |

TABLE 2-continued

| | | | | | | | | |
|---|---|---|---|---|---|---|---|---|
| Urethane particle (trade name: "UCN-5070D", manufactured by Dainichiseika Color & Chemicals Mfg. Co., Ltd.) | 0 | 0 | 0 | 0 | 0 | 0 | 0 | 0 |
| Urethane particle (trade name: "UCN-5150D", manufactured by Dainichiseika Color & Chemicals Mfg. Co., Ltd.) | 0 | 0 | 0 | 0 | 100 | 0 | 20 | 20 |
| Urethane particle (trade name: "C-300 Transparent", manufactured by Negami Chemical Industrial Co., Ltd) | 10 | 0 | 0 | 0 | 0 | 0 | 0 | 0 |
| Urethane particle (trade name: "C-200 Transparent", manufactured by Negami Chemical Industrial Co., Ltd) | 0 | 20 | 0 | 0 | 0 | 0 | 0 | 0 |
| Acrylic particle (trade name: "MX-150", manufactured by Soken Chemical & Engineering Co., Ltd.) | 0 | 0 | 0 | 0 | 0 | 30 | 0 | 0 |
| Acrylic particle (trade name: "MX-1500H", manufactured by Soken Chemical & Engineering Co., Ltd.) | 0 | 0 | 20 | 0 | 0 | 0 | 0 | 0 |
| Carbon black (trade name: "MA100", manufactured by Mitsubishi Chemical Corp.) | 26 | 26 | 26 | 26 | 26 | 5 | 26 | 20 |

Example 1

[1. Formation of Electro-Conductive Elastic Layer]

The elastic roller K-1 was coated with the coating liquid D-1 by the dipping method according to the following procedures. First, the elastic roller K-1 was dipped in the coating liquid with its longitudinal direction as a vertical direction by grasping the upper end of the substrate, and then withdrawn therefrom. In the dipping method of Example 1, the elastic roller was coated with the coating liquid such that the film thickness after curing was 10.0 μm. The dipping time was 9 seconds. The withdrawal speed from the coating liquid was an initial speed of 30 mm/s and a final speed of 20 mm/s, between which the speed was changed linearly against time. The obtained coated product was dried in an oven at a temperature of 80° C. for 15 minutes and then cured by reaction in an oven at a temperature of 140° C. for 2 hours to obtain an electro-conductive elastic roller in which an electro-conductive elastic layer having a film thickness of 10.0 μm was formed around the outer periphery of the elastic roller K-1.

[2. Production of Material E-1 for Insulating Domain]

25 parts by mass of ethoxylated bisphenol A diacrylate (trade name: "A-BPE-4", manufactured by Shin-Nakamura Chemical Co., Ltd.), 75 parts by mass of isobornyl acrylate (trade name: "SR506NS", manufactured by Tomoe Engineering Co., Ltd.) and 5 parts by mass of a photoinitiator 1-hydroxy-cyclohexyl-phenyl-ketone (trade name: "IRGACURE 184", manufactured by BASF SE) were mixed to obtain material E-1 for insulating domains.

[3. Formation of Insulating Domain]

The amount of droplets of the material E-1 for insulating domains was adjusted to 5 pL by using a piezoelectric inkjet head, and the material was applied onto the peripheral surface of the electro-conductive elastic roller. This application was carried out with the electro-conductive elastic roller rotated such that the interval between the circumferential direction and the longitudinal direction of each insulating domain (center-to-center distance) was a pitch of 100 μm. Then, the material E-1 was cured by irradiation for 5 minutes with ultraviolet rays at a wavelength of 254 nm and an integrated quantity of light of 1500 mJ/cm$^2$ using a metal halide lamp to produce the developing roller 1.

[4. Physical Property Evaluation]

Various physical properties of the following (i) to (vii) were measured for the developing roller 1:

(i) surface potentials of the electro-conductive elastic layer and the insulating domains, (ii) Asker C hardness, (iii) "$100S_T/0.09$" (protrusion contact rate) value of electro-conductive elastic layer in contact with a flat glass plate, (iv) horizontal Feret diameter R, (v) "$100S_E/0.09$" (exposure rate) value, (vi) volume resistivities of the insulating domains and the electro-conductive elastic layer, and (vii) Rz (μm) of the electro-conductive elastic layer and diameter (μm) and height (μm) of the insulating domains.

FIG. 6 shows one example of results of observing the state of contact of the electro-conductive elastic layer with the flat glass plate. The electro-conductive elastic layer was in contact as illustrated in FIG. 6, and the "$100S_T/0.09$" value and the horizontal Feret diameter R were 0.50% and 5.3 μm, respectively. The surface potentials of the electro-conductive elastic layer and the insulating domains were 1.2 V and 45.7 V, respectively. The Asker C hardness of the developing roller was 60 degrees. The "$100S_E/0.09$" value was 84%. The evaluation results are shown in Table 4.

[5. Image Evaluation]

The developing roller 1 was installed in an electrophotographic image forming apparatus and subjected to the following image evaluation in a low-temperature and low-humidity environment (temperature: 15° C., relative humidity: 10%).

First, a gear of a toner feed roller was detached from a process cartridge (trade name: HP 304A Magenta, manufactured by Hewlett-Packard Company) for the purpose of decreasing the torque of members for electrography. During operation of this process cartridge, the toner feed roller originally rotates in an opposite direction with respect to the developing roller, but is driven to rotate by the rotation of the developing roller as a result of detaching the gear. This decreases the torque while decreasing the amount of toner fed to the developing roller. Next, the developing roller 1 was installed in this process cartridge, which was in turn installed in a laser beam printer (trade name: Color LaserJet CP2025, manufactured by Hewlett-Packard Company) used as an electrophotographic apparatus. Subsequently, this laser beam printer was aged for 24 hours or longer in a low-temperature and low-humidity environment. The evaluation results of 5-1 and 5-2 are shown in Table 5.

[5-1. Evaluation of Uneven Toner Development and Roughness]

After the aging, a halftone (density: 50%) image was output to one sheet of A4 size in a low-temperature and low-humidity environment. The obtained halftone image was visually evaluated and rated ranks A to D according to the following criteria.

Rank A: The image had no roughness and was excellent.

Rank B: The image had slight roughness, but was favorable.

Rank C: The image had roughness and was within permissible range.

Rank D: The image had roughness and had poor image quality.

[5-2. Evaluation of Amount of Toner Conveyed and Image Density Difference]

After the output of the halftone image, an image having a printing density of 1% was output to 10000 sheets of A4 size in a low-temperature and low-humidity environment, and then, a black solid (density: 100%) image was output to one sheet of A4 size. The image density of the obtained black solid image was measured by using a spectrodensitometer (trade name: 508, manufactured by X-Rite Inc.), and the density difference "$C_1$-$C_2$" of density $C_1$ at the front end and density $C_2$ at the rear end of the image was determined. The results of evaluating the image density difference were rated ranks A to D according to the following criteria.

Rank A: The image was excellent with an image density difference of less than 0.05.

Rank B: The image was good with an image density difference of 0.05 or more and less than 0.10.

Rank C: The image was within permissible range with an image density difference of 0.10 or more and less than 0.20.

Rank D: The image had poor image quality with an image density difference of 0.20 or more.

Examples 2 to 19 and Comparative Examples 1 to 7

Developing rollers 2 to 26 were each produced in the same way as in Example 1 except that the types of the elastic roller and the coating liquid, the amount of droplets of the material E-1 for insulating domains and the insulating domain pitch were changed to the conditions shown in Table 3. Various evaluations were conducted. The evaluation results are shown in Tables 4 and 5.

TABLE 3

| | Production | | | | |
|---|---|---|---|---|---|
| | Developing roller | Elastic roller | Coating liquid for electro-conductive elastic layer | Amount of droplet of insulating domain (pL) | Insulating domain pitch (μm) |
| Example 1 | Developing roller 1 | K-1 | D-1 | 5 | 100 |
| Example 2 | Developing roller 2 | K-1 | D-2 | 5 | 100 |
| Example 3 | Developing roller 3 | K-1 | D-3 | 5 | 100 |
| Example 4 | Developing roller 4 | K-1 | D-4 | 5 | 100 |
| Example 5 | Developing roller 5 | K-1 | D-5 | 5 | 100 |
| Example 6 | Developing roller 6 | K-1 | D-17 | 5 | 100 |
| Example 7 | Developing roller 7 | K-1 | D-3 | 2.5 | 100 |
| Example 8 | Developing roller 8 | K-1 | D-7 | 15 | 100 |
| Example 9 | Developing roller 9 | K-2 | D-3 | 5 | 100 |
| Example 10 | Developing roller 10 | K-3 | D-3 | 5 | 100 |
| Example 11 | Developing roller 11 | K-1 | D-8 | 5 | 100 |
| Example 12 | Developing roller 12 | K-1 | D-9 | 5 | 100 |
| Example 13 | Developing roller 13 | K-1 | D-10 | 5 | 100 |
| Example 14 | Developing roller 14 | K-1 | D-11 | 5 | 100 |
| Example 15 | Developing roller 15 | K-1 | D-3 | 5 | 60 |
| Example 16 | Developing roller 16 | K-1 | D-3 | 5 | 65 |
| Example 17 | Developing roller 17 | K-1 | D-3 | 5 | 120 |
| Example 18 | Developing roller 18 | K-1 | D-3 | 5 | 150 |
| Example 19 | Developing roller 19 | K-1 | D-12 | 5 | 100 |
| Comparative Example 1 | Developing roller 20 | K-1 | D-13 | 5 | 100 |
| Comparative Example 2 | Developing roller 21 | K-1 | D-14 | 5 | 100 |
| Comparative Example 3 | Developing roller 22 | K-1 | D-15 | 5 | 100 |
| Comparative Example 4 | Developing roller 23 | K-1 | D-6 | 2.5 | 100 |
| Comparative Example 5 | Developing roller 24 | K-1 | D-16 | 30 | 100 |
| Comparative Example 6 | Developing roller 25 | K-4 | D-3 | 5 | 100 |
| Comparative Example 7 | Developing roller 26 | K-5 | D-3 | 5 | 100 |

TABLE 4

| | | Physical property evaluation | | | | | |
|---|---|---|---|---|---|---|---|
| | | $100S_T/0.09$ (%) | Electro-conductive elastic layer potential (V) | Insulating domain potential (V) | Asker C hardness (degree) | Horizontal Feret diameter (μm) | $100S_E/0.09$ (%) |
| Example | 1 | 0.50 | 1.2 | 45.7 | 60 | 5.3 | 84 |
| | 2 | 1.00 | 1.4 | 50.0 | 58 | 9.8 | 85 |
| | 3 | 2.10 | 1.2 | 36.3 | 59 | 5.7 | 85 |
| | 4 | 5.00 | 0.9 | 45.9 | 59 | 4.9 | 84 |
| | 5 | 10.00 | 0.8 | 37.7 | 60 | 9.1 | 83 |
| | 6 | 2.73 | 2.0 | 38.6 | 60 | 9.9 | 85 |
| | 7 | 6.43 | 0.6 | 10.0 | 60 | 7.8 | 84 |
| | 8 | 5.01 | 1.2 | 100.0 | 59 | 9.8 | 84 |
| | 9 | 1.12 | 0.5 | 32.2 | 50 | 5.8 | 85 |
| | 10 | 3.13 | 0.1 | 42.8 | 90 | 6.3 | 85 |
| | 11 | 1.50 | 1.3 | 42.4 | 60 | 0.5 | 83 |
| | 12 | 3.20 | 0.9 | 34.8 | 61 | 1.0 | 85 |
| | 13 | 1.61 | 1.1 | 30.7 | 60 | 15.0 | 84 |
| | 14 | 2.52 | 1.3 | 34.9 | 60 | 17.0 | 85 |
| | 15 | 2.67 | 1.8 | 43.0 | 58 | 4.1 | 50 |
| | 16 | 4.12 | 1.7 | 45.9 | 61 | 7.9 | 60 |
| | 17 | 5.43 | 1.7 | 49.7 | 60 | 8.2 | 90 |
| | 18 | 4.61 | 0.7 | 47.1 | 59 | 8.5 | 93 |
| | 19 | 3.42 | 0.5 | 36.0 | 60 | 4.5 | 85 |
| Comparative Example | 1 | 0.10 | 0.8 | 37.8 | 58 | 4.3 | 86 |
| | 2 | 10.10 | 0.9 | 30.4 | 60 | 9.4 | 85 |
| | 3 | 4.08 | 3.0 | 42.8 | 59 | 0.7 | 83 |
| | 4 | 2.68 | 1.4 | 8.0 | 60 | 7.5 | 84 |
| | 5 | 6.49 | 1.1 | 110.0 | 60 | 5.9 | 80 |
| | 6 | 6.40 | 0.3 | 42.9 | 45 | 6.2 | 86 |
| | 7 | 2.15 | 1.4 | 34.8 | 93 | 8.6 | 85 |

| | | Physical property evaluation | | | | |
|---|---|---|---|---|---|---|
| | | Electro-conductive elastic layer Rz (μm) | Insulating domain diameter (μm) | Insulating domain height (μm) | Insulating domain volume resistivity (Ω · cm) | Volume resistivity of electro-conductive elastic layer (Ω · cm) |
| Example | 1 | 9.3 | 45 | 5.5 | 9.6E+14 | 9.6E+05 |
| | 2 | 10.6 | 44 | 5.3 | 6.9E+14 | 9.9E+05 |
| | 3 | 10.0 | 43 | 5.4 | 7.2E+14 | 2.8E+05 |
| | 4 | 12.4 | 45 | 5.0 | 8.7E+14 | 4.2E+05 |
| | 5 | 15.0 | 46 | 5.0 | 7.3E+14 | 7.4E+05 |
| | 6 | 10.1 | 44 | 5.2 | 7.9E+14 | 5.3E+08 |
| | 7 | 10.0 | 45 | 2.0 | 8.5E+14 | 6.0E+05 |
| | 8 | 10.4 | 45 | 13.0 | 8.9E+14 | 2.2E+05 |
| | 9 | 10.0 | 44 | 5.4 | 9.9E+14 | 2.6E+05 |
| | 10 | 10.0 | 43 | 5.4 | 7.8E+14 | 1.1E+05 |
| | 11 | 6.0 | 46 | 5.3 | 6.7E+14 | 4.0E+05 |
| | 12 | 6.8 | 44 | 5.0 | 9.4E+14 | 8.5E+05 |
| | 13 | 14.0 | 45 | 5.0 | 8.8E+14 | 9.0E+05 |
| | 14 | 15.7 | 44 | 5.1 | 8.2E+14 | 2.8E+05 |
| | 15 | 10.0 | 48 | 5.3 | 8.6E+14 | 1.7E+06 |
| | 16 | 10.0 | 46 | 5.5 | 9.1E+14 | 1.3E+06 |
| | 17 | 10.0 | 43 | 5.5 | 5.8E+14 | 9.2E+05 |
| | 18 | 10.0 | 45 | 5.5 | 9.7E+14 | 6.6E+05 |
| | 19 | 16.4 | 44 | 5.3 | 5.6E+14 | 4.2E+05 |
| Comparative Example | 1 | 0.8 | 42 | 5.6 | 8.9E+14 | 1.2E+05 |
| | 2 | 24.2 | 43 | 5.0 | 9.1E+14 | 2.9E+05 |
| | 3 | 4.3 | 46 | 4.5 | 9.3E+14 | 2.3E+11 |
| | 4 | 11.7 | 45 | 1.5 | 6.4E+14 | 1.0E+06 |
| | 5 | 8.0 | 50 | 17.0 | 5.3E+14 | 3.2E+05 |
| | 6 | 10.0 | 42 | 5.5 | 6.2E+14 | 2.3E+05 |
| | 7 | 10.0 | 43 | 5.0 | 6.2E+14 | 3.4E+05 |

TABLE 5

| | Image evaluation | |
|---|---|---|
| | Roughness | Toner conveying ability |
| Example 1 | C | B |
| Example 2 | B | A |
| Example 3 | A | A |
| Example 4 | B | A |
| Example 5 | C | B |
| Example 6 | C | B |
| Example 7 | B | C |
| Example 8 | C | A |
| Example 9 | B | B |
| Example 10 | B | A |
| Example 11 | C | B |
| Example 12 | B | B |
| Example 13 | B | B |
| Example 14 | C | A |
| Example 15 | C | B |
| Example 16 | B | B |
| Example 17 | B | B |
| Example 18 | B | C |
| Example 19 | C | B |
| Comparative Example 1 | D | C |
| Comparative Example 2 | C | D |
| Comparative Example 3 | D | C |
| Comparative Example 4 | C | D |
| Comparative Example 5 | D | B |
| Comparative Example 6 | D | C |
| Comparative Example 7 | D | C |

As is evident from Examples 1 to 5 and Comparative Examples 1 and 2, the developing roller having a "$100S_T/0.09$" (protrusion contact rate) value within the range of the present invention can attain both of improvement in toner conveying ability after use of the image forming apparatus over a long period in a low-temperature and low-humidity environment and the suppression and elimination of uneven toner development at the initial stage of use.

As is evident from Examples 3 and 6 and Comparative Example 3, the developing roller having a surface potential of the electro-conductive elastic layer within the range of the present invention can attain both of improvement in toner conveying ability after use of the image forming apparatus over a long period in a low-temperature and low-humidity environment and the suppression and elimination of uneven toner development at the initial stage of use.

As is evident from Examples 3, 7 and 8 and Comparative Examples 4 and 5, the developing roller having a surface potential of the insulating domains within the range of the present invention can attain both of improvement in toner conveying ability after use of the image forming apparatus over a long period in a low-temperature and low-humidity environment and the suppression and elimination of uneven toner development at the initial stage of use.

As is evident from Examples 3, 9 and 10 and Comparative Examples 6 and 7, the developing roller having an Asker C hardness within the range of the present invention can attain both of improvement in toner conveying ability after use of the image forming apparatus over a long period in a low-temperature and low-humidity environment and the suppression and elimination of uneven toner development at the initial stage of use.

As is evident from Examples 3 and 11 to 14, the developing roller in which the horizontal Feret diameter R of the contacted portions between the surface of the electro-conductive elastic layer and the flat glass plate is 1.0 μm or more and 15.0 μm or less can attain both of improvement in toner conveying ability after use of the image forming apparatus over a long period in a low-temperature and low-humidity environment and the suppression and elimination of uneven toner development at the initial stage of use.

As is evident from Examples 3 and 15 to 18, the developing roller having a "$100S_E/0.09$" (exposure rate) value of 60% or more and 90% or less can attain both of improvement in toner conveying ability after use of the image forming apparatus over a long period in a low-temperature and low-humidity environment and the suppression and elimination of uneven toner development at the initial stage of use.

As is evident from Examples 3 and 19, the developing roller having the electro-conductive elastic layer containing a urethane particle as surface roughening particle can attain both of improvement in toner conveying ability after use of the image forming apparatus over a long period in a low-temperature and low-humidity environment and the suppression and elimination of uneven toner development at the initial stage of use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-035964, filed Feb. 26, 2016 which is hereby incorporated by reference herein in its entirety.

What is claimed is:

1. A developing roller comprising:

a substrate;

an electro-conductive elastic layer on the substrate; and a plurality of electrical insulating domains on the electro-conductive elastic layer, wherein the developing roller has a length L of 200 mm or more in a longitudinal direction orthogonal to the circumferential direction thereof, the surface of the developing roller comprises:

the surfaces of the domains; and an exposed portion of the electro-conductive elastic layer, the exposed portion being uncovered with the domains, the developing roller has protrusions on the surface thereof, the protrusion being formed by the domains, the electro-conductive elastic layer has a plurality of protrusions at the exposed portion, the developing roller has an Asker C hardness of 50 degrees or more and 90 degrees or less, and the developing roller satisfies the following (1) and (2):

(1) a surface potential of the developing roller at the domains is 10 V or more and 100 V or less corresponding to a completion of discharge, and a surface potential of the developing roller at the exposed portion of the electro-conductive elastic layer is 2 V or less corresponding to a completion of discharge, the charging of the surface of the developing roller being conducted with a discharge wire which is disposed substantially parallel to the longitudinal direction of the developing roller and so that the discharge wire is apart from the surface of the developing roller by 1 mm, by applying a direct-current voltage of 8 kV between the developing roller and the discharge wire in an environment of a temperature of 23° C. and a relative humidity of 50%, and (2) when a nip region having a nip width of 1.0 mm and an area of 1.0 mm×L mm is demarcated by pressing the surface of the developing roller against a flat glass plate, assuming that a square region of 0.3 mm on a side is placed in the nip region, and total sum of areas of contacted portions between the exposed portion of the electro-conductive elastic layer and the flat glass plate in the square region is defined as "$S_T$" $mm^2$, a percentage ratio of $S_T$ to the area 0.09 $mm^2$ of the square region, $100*S_T/0.09$, is 0.50% or more and 10.00% or less.

2. The developing roller according to claim 1, wherein horizontal Feret diameter R of the contacted portions between the exposed portion of the electro-conductive elastic layer and the flat glass plate is 1.0 μm or more and 15.0 μm or less.

3. The developing roller according to claim 1, wherein, assuming that a square region of 0.3 mm on a side is placed on the surface of the developing roller, and an area of the exposed portion of the electro-conductive elastic layer in the square region is defined as "$S_E$" $mm^2$, a percentage ratio of $S_E$ to the area 0.09 $mm^2$ of the square region, $100*S_E/0.09$, is 60% or more and 90% or less.

4. The developing roller according to claim 1, wherein, the electro-conductive elastic layer comprises a urethane resin particle, and the plurality of protrusions at the exposed portion of the electro-conductive elastic layer are derived from the urethane resin particle.

5. The developing roller according to claim 1, wherein the domains have a volume resistivity of $1\times10^{13}$ Ω·cm or more and $1\times10^{17}$ Ω·cm or less, and the electro-conductive elastic layer has a volume resistivity of $1\times10^{3}$ Ω·cm or more and $1\times10^{11}$ Ω·cm or less.

6. The developing roller according to claim 1, wherein the domains contain a resin.

7. The developing roller according to claim 6, wherein the resin is an acrylic resin.

8. The developing roller according to claim 1, wherein the electro-conductive elastic layer comprises any one of or both of a resin and a rubber, and an electro-conductive agent.

9. The developing roller according to claim 1, wherein the electro-conductive elastic layer comprises a polyether polyurethane as a binder resin.

10. An electrophotographic process cartridge which is configured to be detachably attachable to a body of an electrophotographic apparatus, comprising a developing apparatus, wherein the developing apparatus comprises a developing roller, the developing roller comprising:

a substrate;

an electro-conductive elastic layer on the substrate; and a plurality of electrical insulating domains on the electro-conductive elastic layer, wherein the developing roller has a length L of 200 mm or more in a longitudinal direction orthogonal to the circumferential direction thereof, the surface of the developing roller comprises:

the surfaces of the domains; and an exposed portion of the electro-conductive elastic layer, the exposed portion being uncovered with the domains, the developing roller has protrusions on the surface thereof, the protrusion being formed by the domains, the electro-conductive elastic layer has a plurality of protrusions at the exposed portion, the developing roller has an Asker C hardness of 50 degrees or more and 90 degrees or less, and the developing roller satisfies the following (1) and (2):

(1) a surface potential of the developing roller at the domains is 10 V or more and 100 V or less corresponding to a completion of discharge, and a surface potential of the developing roller at the exposed portion of the electro-conductive elastic layer is 2 V or less corresponding to a completion of discharge, the charging of the surface of the developing roller being conducted with a discharge wire which is disposed substantially parallel to the longitudinal direction of the developing roller and so that the discharge wire is apart from the surface of the developing roller by 1 mm, by applying a direct-current voltage of 8 kV between the developing roller and the discharge wire in an environment of a temperature of 23° C. and a relative humidity of 50%, and (2) when a nip region having a nip width of 1.0 mm and an area of 1.0 mm×L mm is demarcated by pressing the surface of the developing roller against a flat glass plate, assuming that a square region of 0.3 mm on a side is placed in the nip region, and total sum of areas of contacted portions between the exposed portion of the electro-conductive elastic layer and the flat glass plate in the square region is defined as "$S_T$" $mm^2$, a percentage ratio of $S_T$ to the area 0.09 $mm^2$ of the square region, $100*S_T/0.09$, is 0.50% or more and 10.00% or less.

11. An electrophotographic image forming apparatus comprising an image bearing member which bears an electrostatic latent image, a charging apparatus which charges the image bearing member, an exposure apparatus which forms an electrostatic latent image on the charged image bearing member, a developing apparatus which develops the electrostatic latent image with toner to form a toner image, and a transfer apparatus which transfers the toner image to a transfer material, wherein the developing apparatus comprises a developing roller, the developing roller comprising:

a substrate;

an electro-conductive elastic layer on the substrate; and a plurality of electrical insulating domains on the electro-conductive elastic layer, wherein the developing roller has a length L of 200 mm or more in a longitudinal direction orthogonal to the circumferential direction thereof, the surface of the developing roller comprises:

the surfaces of the domains; and an exposed portion of the electro-conductive elastic layer, the exposed portion being uncovered with the domains, the developing roller has protrusions on the surface thereof, the protrusion being formed by the domains, the electro-conductive elastic layer has a plurality of protrusions at the exposed portion, the developing roller has an Asker C hardness of 50 degrees or more and 90 degrees or less, and the developing roller satisfies the following (1) and (2):

(1) a surface potential of the developing roller at the domains is 10 V or more and 100 V or less corresponding to a completion of discharge, and a surface potential of the developing roller at the exposed portion of the electro-conductive elastic layer is 2 V or less corresponding to a completion of discharge, the charging of the surface of the developing roller being conducted with a discharge wire which is disposed substantially parallel to the longitudinal direction of the developing roller and so that the discharge wire is apart from the surface of the developing roller by 1 mm, by applying a direct-current voltage of 8 kV between the developing roller and the discharge wire in an environment of a temperature of 23° C. and a relative humidity of 50%, and (2) when a nip region having a nip width of 1.0 mm and an area of 1.0 mm×L mm is demarcated by pressing the surface of the developing roller against a flat glass plate, assuming that a square region of 0.3 mm on a side is placed in the nip region, and total sum of areas of contacted portions between the exposed portion of the electro-conductive elastic layer and the flat glass plate in the square region is defined as "$S_T$" $mm^2$, a percentage ratio of $S_T$ to the area 0.09 $mm^2$ of the square region, $100*S_T/0.09$, is 0.50% or more and 10.00% or less.

* * * * *